US007752998B1

(12) United States Patent
Noble

(10) Patent No.: US 7,752,998 B1
(45) Date of Patent: Jul. 13, 2010

(54) PAINT PROTECTION APPARATUS

(76) Inventor: James Noble, 12920 Riding Trail Dr., Wilton, CA (US) 95693

( * ) Notice: Subject to any disclaimer, the term of this patent is extended or adjusted under 35 U.S.C. 154(b) by 736 days.

(21) Appl. No.: 11/600,639

(22) Filed: Nov. 17, 2006

Related U.S. Application Data

(60) Provisional application No. 60/756,964, filed on Jan. 5, 2006.

(51) Int. Cl.
*B05C 21/00* (2006.01)

(52) U.S. Cl. ..... 118/504; 118/305; 118/35

(58) Field of Classification Search ..... 118/504, 118/505; 83/649, 614; 225/39, 44, 56; 242/578, 242/578.2; 248/256, 257, 259, 260, 265, 248/271, 272; 428/343
See application file for complete search history.

(56) References Cited

U.S. PATENT DOCUMENTS 3,735,658 A * 5/1973 Swann ..... 83/433
6,383,567 B2 * 5/2002 Ager et al. ..... 427/282
7,022,188 B2 * 4/2006 Ganci ..... 118/504
2003/0209122 A1 * 11/2003 Nguyen ..... 83/614
2004/0144882 A1 * 7/2004 Small et al. ..... 242/559
2007/0137454 A1 * 6/2007 DesRosiers et al. ..... 83/614

* cited by examiner

*Primary Examiner*—Laura Edwards

(57) ABSTRACT

A paint protection apparatus includes a body formed from paint-impermeable material configured in a wound and tubular configuration, and having integrally coupled outer and inner layers covering an entire surface area thereof. The inner layer is formed from an adhesive material. A plurality of perforations passes through the layers, and extends along the entire longitudinal length of the body. A mechanism separates the body along a linear axis registered orthogonal to a longitudinal length of the body while the body is separated along at least one of the perforations. A mechanism unwinds and dispenses the body while one user hand remains spaced from the unwinding and dispensing mechanism during operating conditions. The separating mechanism is slidably positioned along a longitudinal length of the unwinding and dispensing mechanism.

8 Claims, 7 Drawing Sheets

PAINT PROTECTION APPARATUS

CROSS REFERENCE TO RELATED APPLICATIONS

This application claims the benefit of U.S. Provisional Application No. 60/756,964, filed on Jan. 5, 2006.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to protection apparatuses and, more particularly, to a paint protection apparatus for shielding a target zone from undesirable paint streaks during painting operations.

2. Prior Art

In the past it was customary for painters to use drop cloths or newspapers for protecting areas in a structure that were not to be painted from paint droppings and splatters. These protective methods quite often did not prevent paint from dripping down the wall to the juncture where the wall meets the floor since the drop cloth or other type of paint protection device does not adequately seal the wall or baseboard thereby preventing paint from falling on the edges between the wall and the floor or floor coverings.

One prior art example shows a device for protecting floors and floor coverings from paint and splatter having a board with flexible lips that can seal the wall from the floor surfaces. The device can also be bent to accommodate curved surfaces, such as columns. Unfortunately, this prior art example requires a user to hold the apparatus with one hand while painting a surface with the other hand, thus increasing inconvenience for the painter. Such an apparatus also has a limited coverage area, and does not effectively seal the juncture of the apparatus and the surface to be protected.

Another prior art example shows a method of temporarily protecting a surface which includes the steps of applying a continuous coating of a masking material to said surface, which masking material comprises, before drying, an aqueous solution or emulsion consisting essentially of a film-forming, carboxylic acid-containing polymer; coating all or a portion of said surface with a coating compound, said masking material preventing said coating compound from contacting said surface; and, thereafter, removing said masking material from said surface. Preferably said carboxylic acid-containing polymer is an acrylic or methacrylic acid-containing copolymer and is the sole film-forming component of the aqueous solution or emulsion. Unfortunately, this prior art example requires the use of a liquid compound which may be difficult to apply and requires a drying time, which may inconveniently delay a painter in accomplishing his task.

Accordingly, a need remains for a paint protection apparatus in order to overcome the above-noted shortcomings. The present invention satisfies such a need by providing an apparatus that is simple and easy to use, is lightweight yet durable in design, and shields a target zone from undesirable paint streaks during painting operations. Such an apparatus is easily applied and removed without the use of liquids, chemicals or compounds, and does not require a drying time before becoming effective. The apparatus is applicable to many different types of surfaces and does not damage the surface it is applied to. The present invention is inexpensive and easily transportable.

BRIEF SUMMARY OF THE INVENTION

In view of the foregoing background, it is therefore an object of the present invention to provide a paint protection apparatus. These and other objects, features, and advantages of the invention are provided by an apparatus for shielding a target zone from undesirable paint streaks during painting operations.

The apparatus includes a body formed from paint-impermeable material configured in a wound and tubular configuration such that an unwound portion of the body is conveniently detachable from a wound portion while the wound portion effectively maintains the tubular configuration. Such a body includes integrally coupled outer and inner layers effectively covering an entire surface area of the body. Such an inner layer is advantageously formed from an adhesive material. The body further includes a peelable protective layer preferably formed from plastic material. The protective layer is removable from the adhesive layer and is also perforated along linearly aligned paths with the perforations described hereinbelow. Thus, the operator can effectively and quickly detach all the segments of the body (inner and outer layers as well as the protective layer) along the perforations during operating conditions. Notably, such perforations along the protective layer can be criss-crossed along a hatch-pattern or aligned in a parallel arrangement along a longitudinal length of the body.

The body further includes a plurality of perforations formed therein and passing through the outer and inner layers for effectively defining lines of weakness along which the body is readily separable while the wound portion remains statically disposed at the tubular configuration such that a user can quickly detach the unwound portion without disrupting the wound portion. Each of such perforations extends along the entire longitudinal length of the body such that a lateral width of the body is uniformly reduced when one section of the body is separated along an associated one of the perforations and along the entire longitudinal length of the body respectively.

The apparatus further includes a mechanism for simultaneously separating the body along a linear axis registered orthogonal to a longitudinal length of the body while the body is advantageously separated along at least one of the perforations such that a selected area of the unwound portion is effectively separated from the body while a remaining portion of the unwound portion remains conveniently intact with the body. Such a separating mechanism is slidably positioned along a longitudinal length of the unwinding and dispensing mechanism (herein described below).

The separating mechanism includes a cutting implement provided with a blade formed at a distal tip thereof. Such a cutting implement includes a housing directly coupled to the blade, and has a bore passing therethrough. A central region (herein described below) is linearly seated through the bore such that the housing is freely adapted along the longitudinal length of the central region. Such a blade is orthogonally registered and extends downwardly from the central region of the holding implement (herein described below) such that the unwound portion effectively engages the blade when the body is flexed upwardly and towards the holding implement. The blade traverses across at least one of the perforations during cutting procedures. The blade is vertically adjustable along a front face of the housing, and is advantageously detachable from the housing while the housing remains anchored to the central region.

The separating mechanism further includes a plurality of stop members in frictional communication with the central region. Such stop members are advantageously spaced on opposite sides of the housing and the blade respectively, and further are linearly positional along the central region for effectively restricting lateral movement of the housing and the blade during cutting procedures respectively.

The apparatus further includes a mechanism for unwinding and dispensing the body so that the unwound portion is evenly pulled away from the tubular configuration while one user hand remains advantageously spaced from the unwinding and dispensing mechanism during operating conditions. Such an unwinding and dispensing mechanism preferably includes a holding implement that has axially offset U-shaped end portions facing inwardly toward each other. Each of such U-shaped end portions is removably seated within axially opposed ends of the body while the body is adapted at the tubular configuration such that the body is advantageously journaled about the U-shaped end portions and freely rotatable thereabout. Such a holding implement further includes a telescopic central region monolithically formed with the U-shaped end portions in such a manner that a longitudinal length of the holding implement is conveniently adaptable to alternate lengths after the selected area of the unwound portion of the body is detached from the body.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
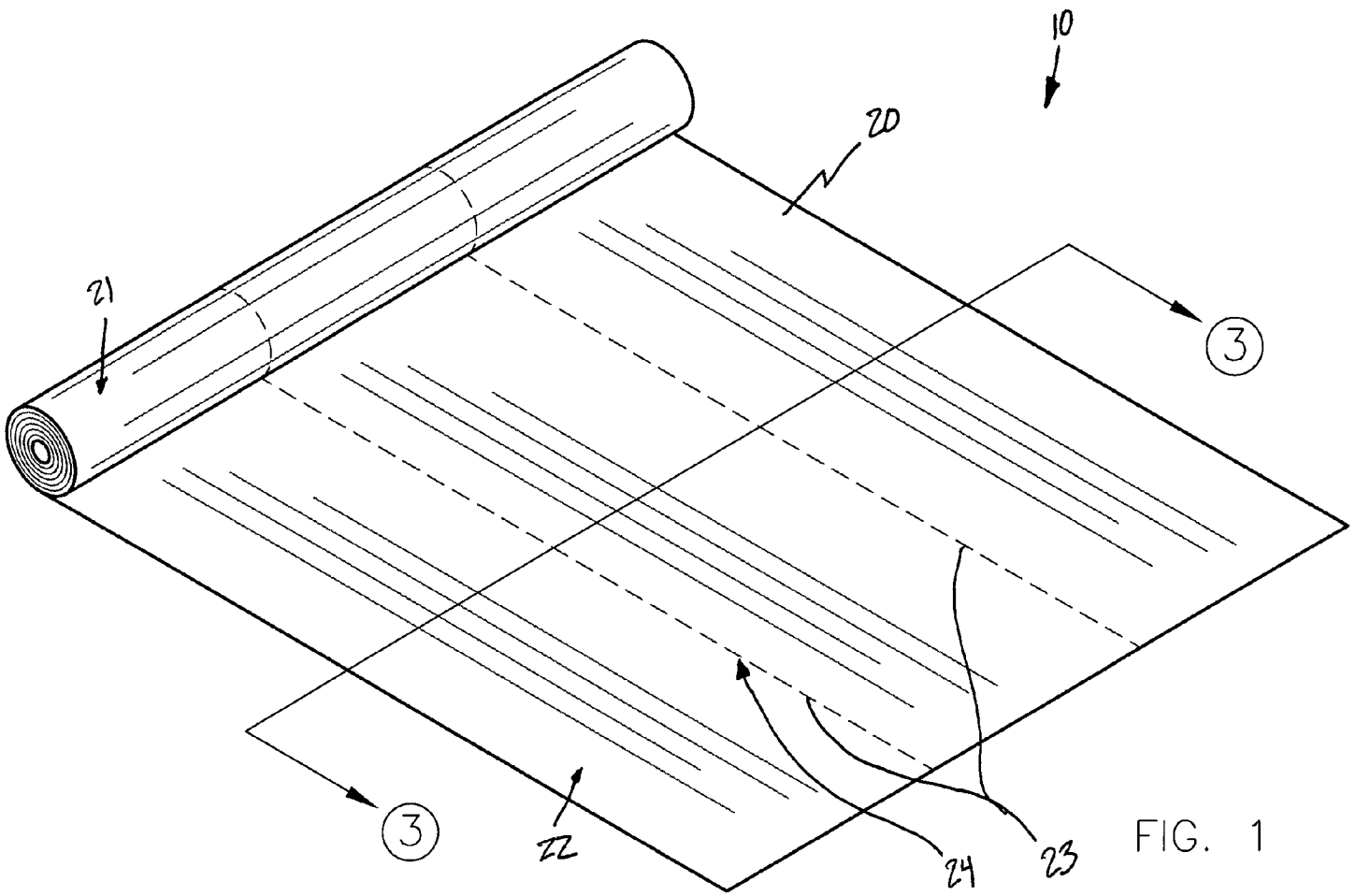
FIG. 1 is a perspective view of a paint protection apparatus showing the paint-impermeable material in an unwound position, and showing three separable sections, in accordance with the present invention.
Figure 2:
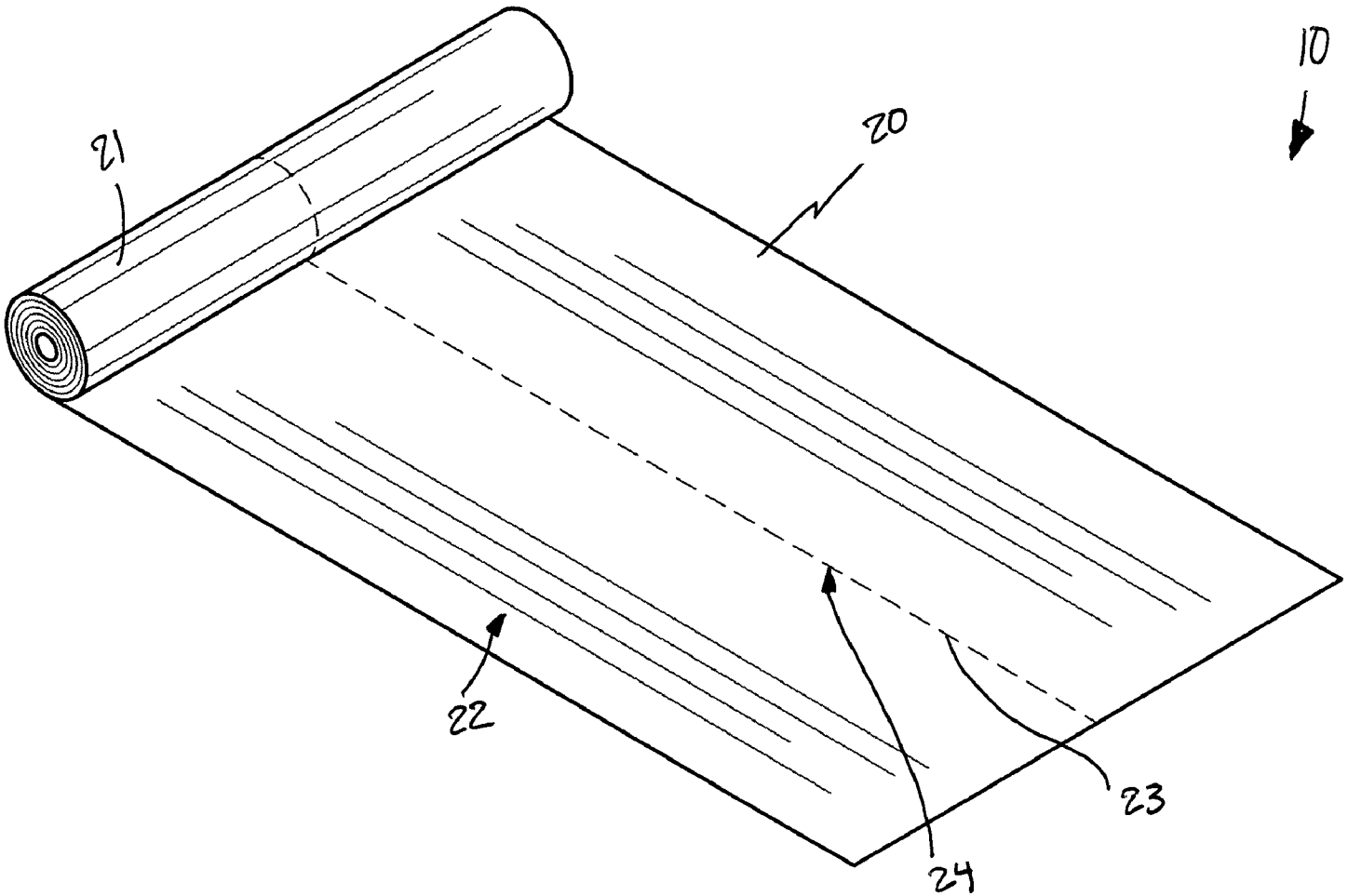
FIG. 2 is a perspective view of the apparatus shown in FIG. 1, showing two separable sections.
Figure 3:
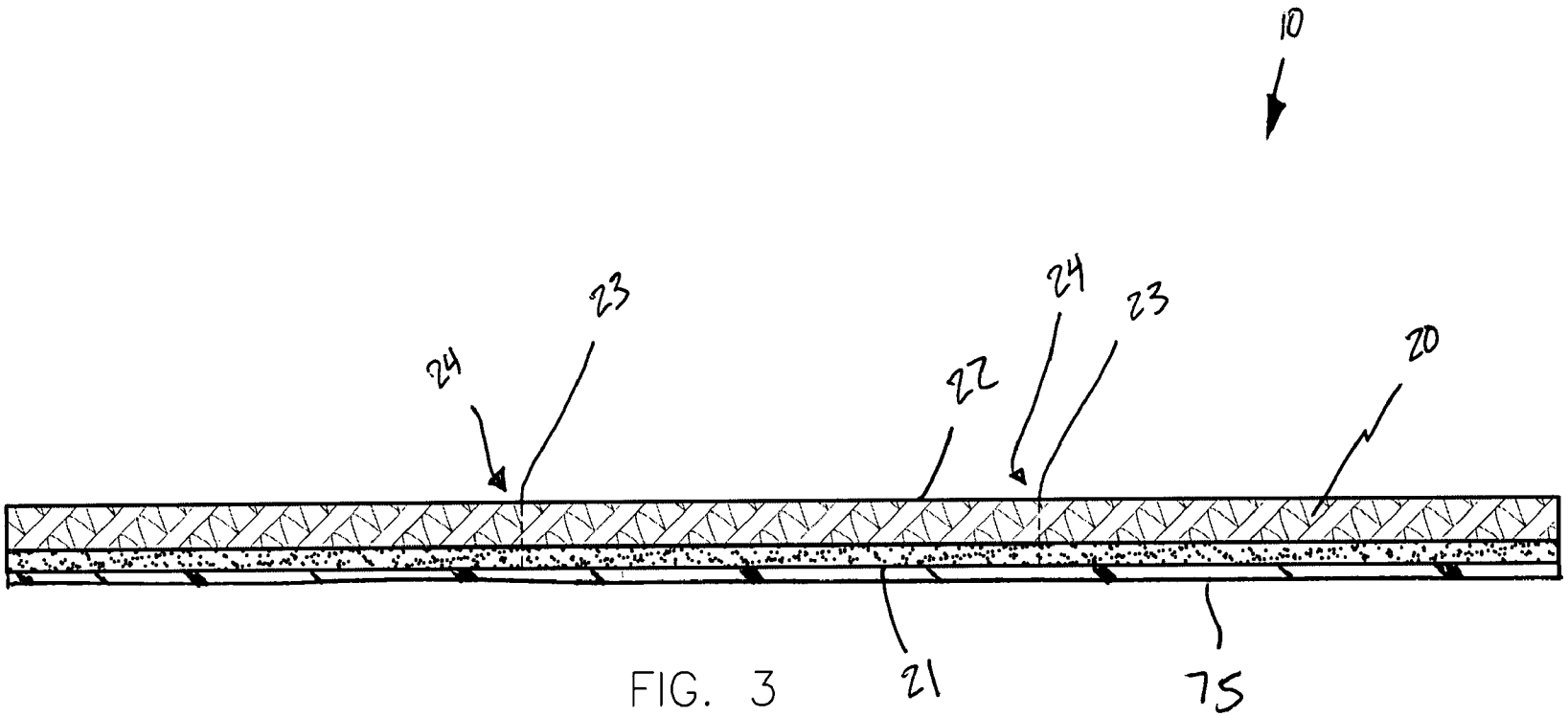
FIG. 3 is a cross sectional view of the apparatus shown in FIG. 1, taken along line 3-3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-7 by the reference numeral 10 and is intended to provide a paint protection apparatus. It should be understood that the apparatus 10 may be used to protect many different types of surfaces from many different types of substances and should not be limited in use to protecting only those surfaces from those substances described herein.

Referring to FIGS. 1, 2, 3, 4, 5, 6 and 7, the apparatus 10 includes a body 20 formed from paint-impermeable material configured in a wound and tubular configuration, which is essential such that an unwound portion of the body 20 is detachable from a wound portion while the wound portion maintains the tubular configuration. Of course, such a body 20 can be formed from a variety of suitably paint-impermeable materials, as is obvious to a person of ordinary skill in the art. Such a body 20 includes integrally coupled outer 21 and inner 22 layers covering an entire surface area of the body 20. Such an inner layer 22 is formed from an adhesive material. Of course, such an inner layer 22 can be formed from a variety of suitably adhesive materials, as is obvious to a person of ordinary skill in the art.

The body 20 further includes a peelable protective layer 75 preferably formed from plastic material or other suitable non-stick material. The protective layer 75 is removable from the inner layer 22 and is also perforated along linearly aligned paths with the perforations 23 described hereinbelow. Thus, the operator can effectively and quickly detach all layers 21, 22, 75 of the body (inner and outer layers as well as the protective layer) along the perforations 23 during operating conditions. Notably, such perforations 23 penetrate to the protective layer and can be defined along a criss-crossed hatch-pattern or aligned in a parallel arrangement along a longitudinal length of the body. The peelable protective layer 75 is critically and necessarily sized and shaped to cover an entire surface area of the inner layer 22 such that a remaining portion of the inner layer 22, which remains intact with the body 20 and outer layer 21, is continuously protected during rolled and inoperable conditions.

Referring to FIGS. 1, 2, 3, 4, 5 and 6, the body 20 further includes a plurality of perforations 23 formed therein and passing through the outer and inner layers 21, 22 for defining lines of weakness 24 along which the body 20 is readily separable while the wound portion remains statically disposed at the tubular configuration, which is critical such that a user can quickly detach the unwound portion without disrupting the wound portion. Each of such perforations 23 extends along the entire longitudinal length of the body 20, which is crucial such that a lateral width of the body 20 is uniformly reduced when one section of the body 20 is separated along an associated one of the perforations 23 and along the entire longitudinal length of the body 20 respectively.

Referring to FIGS. 4, 5, 6 and 7, the apparatus 10 further includes a mechanism 25 for simultaneously separating the body 20 along a linear axis registered orthogonal to a longitudinal length of the body 20 while the body 20 is advantageously separated along at least one of the perforations 23, which is vital such that a selected area of the unwound portion is separated from the body 20 while a remaining portion of the unwound portion remains intact with the body 20. Such a separating mechanism 25 is slidably positioned along a longitudinal length of the unwinding and dispensing mechanism 26 (herein described below).

Again referring to FIGS. 4, 5, 6 and 7, the separating mechanism 25 includes a cutting implement 27 provided with a blade 28 formed at a distal tip 29 thereof. Such a cutting implement 27 includes a housing 31 directly coupled to the blade 28, without the use of intervening elements, and has a bore 32 passing therethrough. Of course, such a bore 32 can be formed in a variety of shapes and sizes, as is obvious to a person of ordinary skill in the art. A central region 33 (herein described below) is linearly seated through the bore 32, which is important such that the housing 31 is freely adapted along the longitudinal length of the central region 33.

Yet again referring to FIGS. 4, 5, 6 and 7, the blade 28 is orthogonally registered and extends downwardly from the central region 33 of the holding implement 41 (herein described below) such that the unwound portion engages the blade 28 when the body 20 is flexed upwardly and towards the holding implement 41. The blade 28 traverses across at least one of the perforations 23 during cutting procedures. The blade 28 is vertically adjustable along a front face of the housing 31, and is advantageously detachable from the housing 31 while the housing 31 remains anchored to the central region 33.

Figure 4:
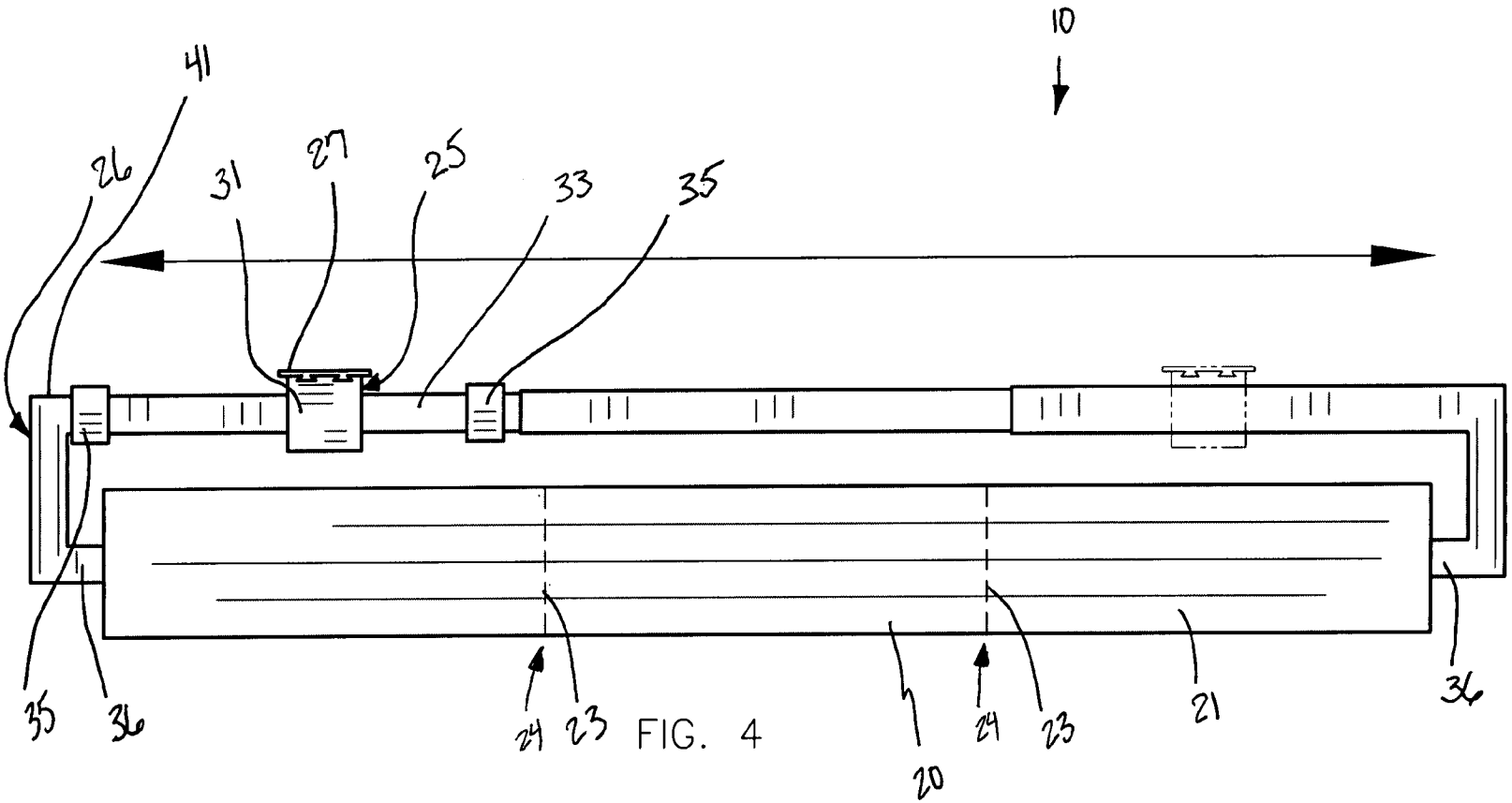
FIG. 4 is a top plan view of the apparatus shown in FIG. 1.
Figure 5:
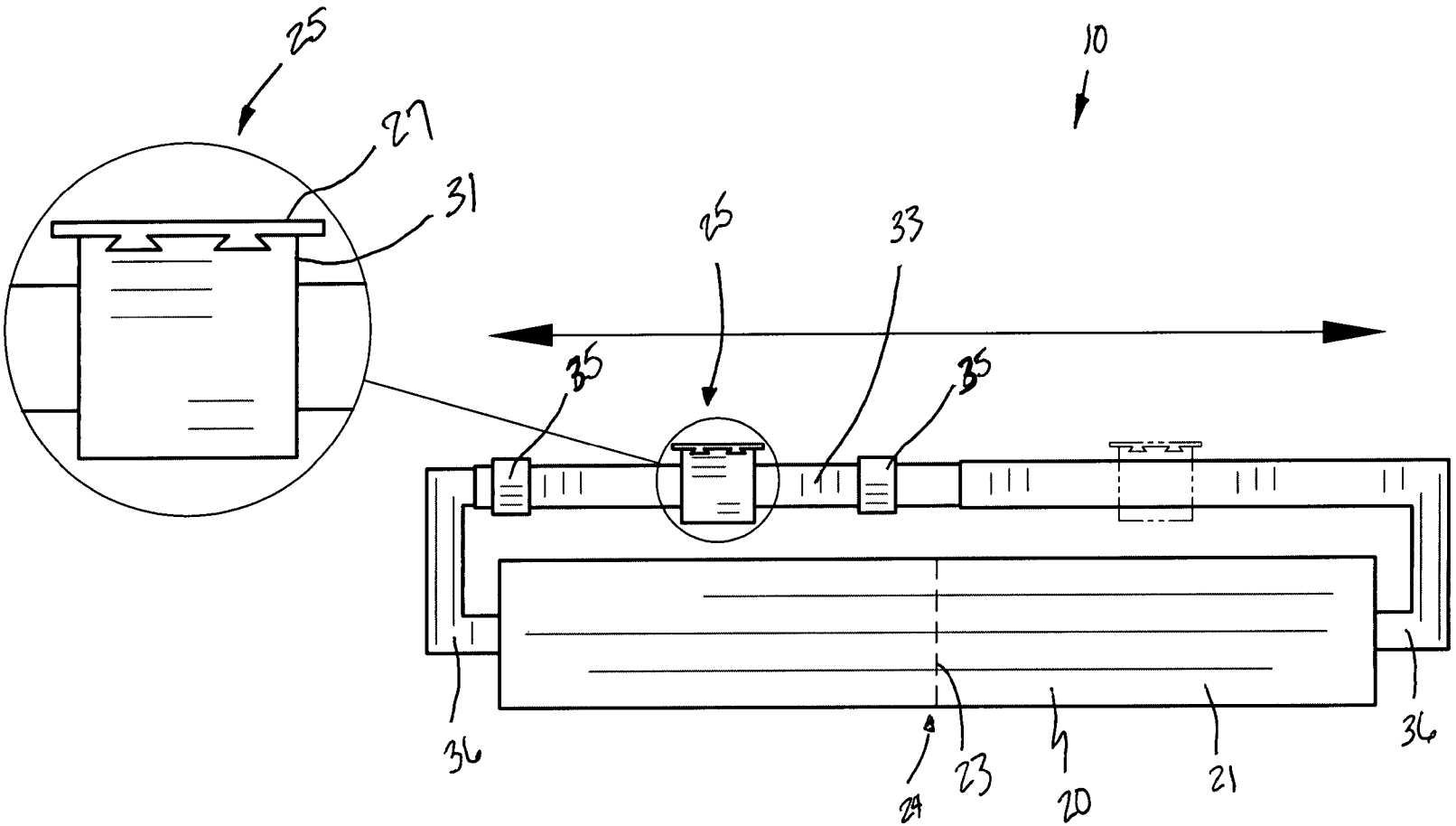
FIG. 5 is a top plan view of the apparatus shown in FIG. 2, showing an expanded view of the separating mechanism.
Figure 6:
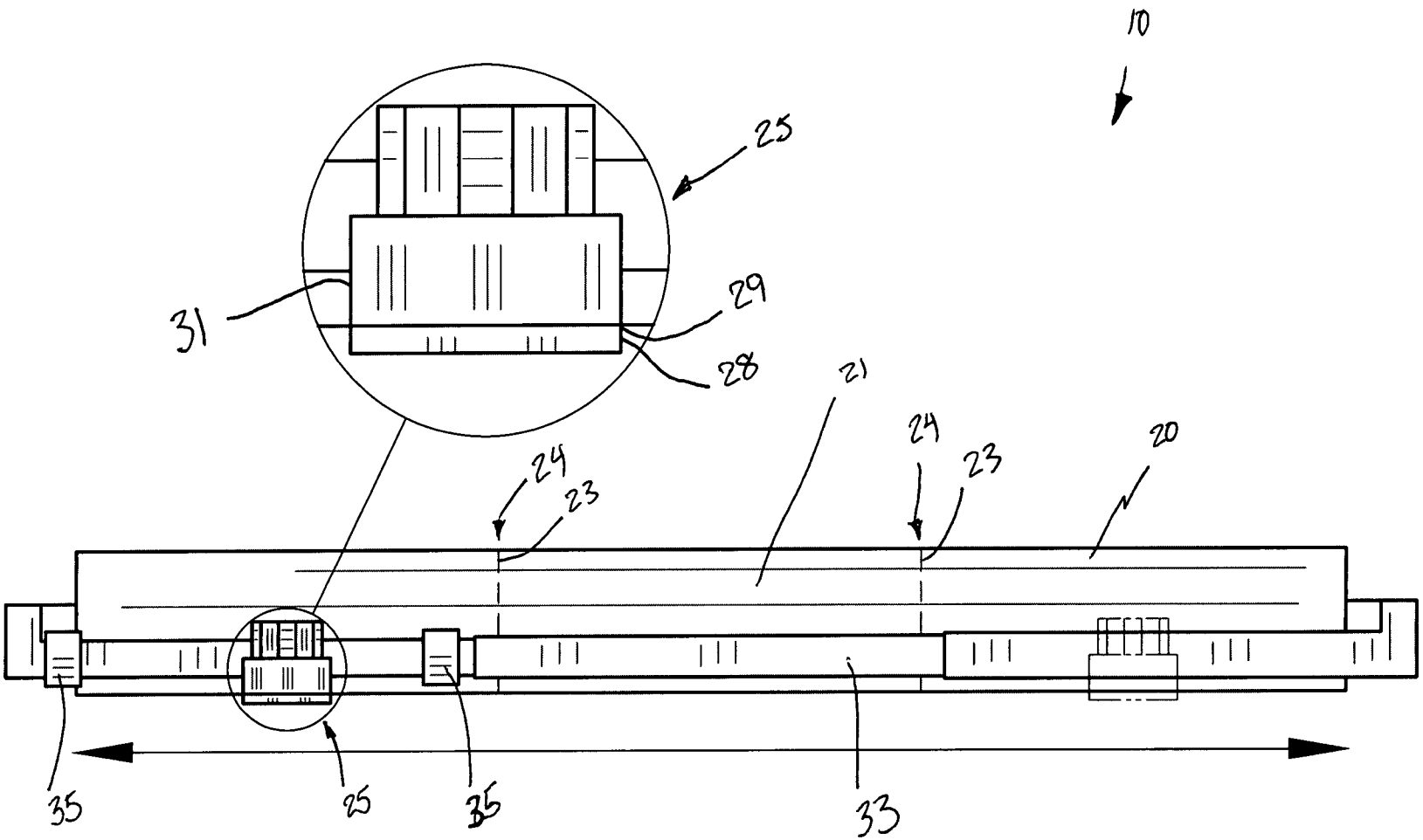
FIG. 6 is a front elevational view of the apparatus shown in FIG. 1, showing an expanded view of the separating mechanism.
Figure 7:
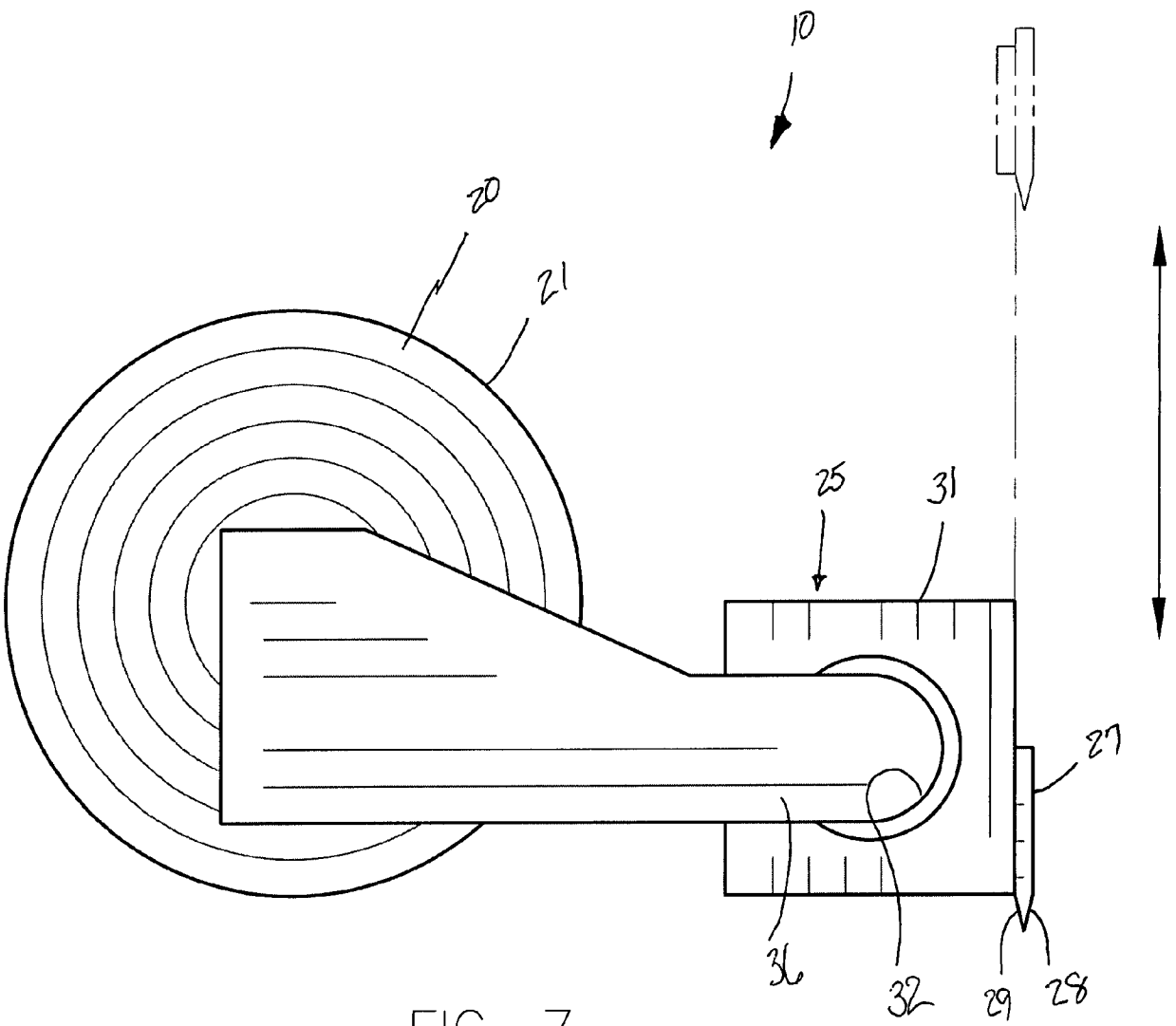
FIG. 7 is a side elevational view of the apparatus shown in FIG. 1.

Referring to FIGS. 4, 5 and 6, the separating mechanism 25 further includes a plurality of stop members 35 in frictional communication with the central region 33. Such stop members 35 are advantageously spaced on opposite sides of the housing 31 and the blade 28 respectively, and further are linearly positional along the central region 33 for effectively restricting lateral movement of the housing 31 and the blade 28 during cutting procedures respectively. Of course, such stop members 35 can be produced in a variety of shapes and sizes, as is obvious to a person of ordinary skill in the art.

Still referring to FIGS. 4, 5, 6 and 7, the apparatus 10 further includes a mechanism 26 for unwinding and dispensing the body 20, which is essential such that the unwound portion is evenly pulled away from the tubular configuration while one user hand remains advantageously spaced from the unwinding and dispensing mechanism 26 during operating conditions. Such an unwinding and dispensing mechanism 26 includes a holding implement 41 that has axially offset U-shaped end portions 36 facing inwardly toward each other.

Each of such U-shaped end portions 36 is removably seated within axially opposed ends of the body 20 while the body 20 is adapted at the tubular configuration, which is critical such that the body 20 is advantageously journaled about the U-shaped end portions 36 and freely rotatable thereabout. Such a holding implement 41 further includes a telescopic central region 33 monolithically formed with the U-shaped end portions 36, which is crucial such that a longitudinal length of the holding implement 41 is adaptable to alternate lengths after the selected area of the unwound portion of the body 20 is detached from the body 20.

The ability to selectively size and detach an amount of material using the included unwinding and dispensing mechanism 26 and separating mechanism 25 respectively, provides the unexpected benefit of allowing a user to perform the above operation using one, self-contained unit, thereby overcoming prior art shortcomings.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for shielding a target zone from undesirable paint streaks during painting operations, said shielding apparatus comprising:

a body formed from paint-impermeable material configured in a wound and tubular configuration such that an unwound portion of said body is detachable from a wound portion while said wound portion maintains the tubular configuration, said body including integrally coupled outer and inner layers covering an entire surface area of said body, said inner layer being formed from an adhesive material, said body further including a plurality of perforations formed therein and passing through said outer and inner layers for defining lines of weakness along which said body is readily separable while said wound portion remains statically disposed at the tubular configuration such that a user can quickly detach said unwound portion without disrupting said wound portion;

means for simultaneously separating said body along a linear axis registered orthogonal to a longitudinal length of said body while said body is being separated along at least one of said perforations such that a selected area of said unwound portion is separated from said body while a remaining portion of said unwound portion remains intact with said body; and means for unwinding and dispensing said body so that said unwound portion is evenly pulled away from said tubular configuration while one user hand remains spaced from said unwinding and dispensing means during operating conditions;

wherein said separating means is slidably positioned along a longitudinal length of said unwinding and dispensing means;

wherein said unwinding and dispensing means comprises a holding implement having axially offset U-shaped end portions facing inwardly toward each other, each of said U-shaped end portions being removably seated within axially opposed ends of said body while said body is adapted at the tubular configuration such that said body is journaled about said U-shaped end portions and freely rotatable thereabout, wherein said holding implement further including a telescopic central region monolithically formed with said U-shaped end portions in such a manner that a longitudinal length of said holding implement is adaptable to alternate lengths after the selected area of said unwound portion of said body is detached from said body.

2. The shielding apparatus of claim 1, wherein said separating means comprises:

a cutting implement provided with a blade formed at a distal tip thereof, said blade being orthogonally registered and extending downwardly from said central region of said holding implement such that the unwound portion engages said blade when said body is flexed upwardly and towards said holding implement, said blade traversing across at least one of said perforations during cutting procedures, wherein said blade is vertically adjustable along a front face of said housing, said blade being detachable from said housing while said housing remains anchored to said central region.

3. The shielding apparatus of claim 2, wherein said cutting implement includes a housing directly coupled to said blade, said housing having a bore passing therethrough, said central region being linearly seated through said bore such that said housing is freely adapted along the longitudinal length of said central region.

4. The shielding apparatus of claim 3, wherein said separating means further comprises:

a plurality of stop members in frictional communication with said central region, said stop members being spaced on opposite sides of said housing and said blade respectively and further being linearly positional along said central region for restricting lateral movement of said housing and said blade during cutting procedures respectively.

5. An apparatus for shielding a target zone from undesirable paint streaks during painting operations, said shielding apparatus comprising:

a body formed from paint-impermeable material configured in a wound and tubular configuration such that an unwound portion of said body is detachable from a wound portion while said wound portion maintains the tubular configuration, said body including integrally coupled outer and inner layers covering an entire surface area of said body, said inner layer being formed from an adhesive material, said body further including a plurality of perforations formed therein and passing through said outer and inner layers for defining lines of weakness along which said body is readily separable while said wound portion remains statically disposed at the tubular configuration such that a user can quickly detach said unwound portion without disrupting said wound portion, wherein each of said perforations extends along the entire longitudinal length of said body such that a lateral width of said body is uniformly reduced when one section of said body is separated along an associated one of said perforations and along the entire longitudinal length of said body respectively;

means for simultaneously separating said body along a linear axis registered orthogonal to a longitudinal length of said body while said body is being separated along at least one of said perforations such that a selected area of said unwound portion is separated from said body while a remaining portion of said unwound portion remains intact with said body; and means for unwinding and dispensing said body so that said unwound portion is evenly pulled away from said tubular configuration while one user hand remains spaced from said unwinding and dispensing means during operating conditions;

wherein said separating means is slidably positioned along a longitudinal length of said unwinding and dispensing means;

wherein said unwinding and dispensing means comprises a holding implement having axially offset U-shaped end portions facing inwardly toward each other, each of said U-shaped end portions being removably seated within axially opposed ends of said body while said body is adapted at the tubular configuration such that said body is journaled about said U-shaped end portions and freely rotatable thereabout, wherein said holding implement further including a telescopic central region monolithically formed with said U-shaped end portions in such a manner that a longitudinal length of said holding implement is adaptable to alternate lengths after the selected area of said unwound portion of said body is detached from said body.

6. The shielding apparatus of claim 5, wherein said separating means comprises:

a cutting implement provided with a blade formed at a distal tip thereof, said blade being orthogonally registered and extending downwardly from said central region of said holding implement such that the unwound portion engages said blade when said body is flexed upwardly and towards said holding implement, said blade traversing across at least one of said perforations during cutting procedures, wherein said blade is vertically adjustable along a front face of said housing, said blade being detachable from said housing while said housing remains anchored to said central region.

7. The shielding apparatus of claim 6, wherein said cutting implement includes a housing directly coupled to said blade, said housing having a bore passing therethrough, said central region being linearly seated through said bore such that said housing is freely adapted along the longitudinal length of said central region.

8. The shielding apparatus of claim 7, wherein said separating means further comprises:

a plurality of stop members in frictional communication with said central region, said stop members being spaced on opposite sides of said housing and said blade respectively and further being linearly positional along said central region for restricting lateral movement of said housing and said blade during cutting procedures respectively.

* * * * *